US008585171B2

(12) United States Patent
Bhaumik et al.

(10) Patent No.: US 8,585,171 B2
(45) Date of Patent: Nov. 19, 2013

(54) COLOR PROFILE DETERMINATION FOR PRINTING SYSTEMS

(75) Inventors: Roshmi Bhaumik, Longmont, CO (US); John W. Lamb, Jr., Boulder, CO (US); Kenneth S. Shouldice, Firestone, CO (US)

(73) Assignee: Ricoh Production Print Solutions, Boulder, CO (US)

( * ) Notice: Subject to any disclaimer, the term of this patent is extended or adjusted under 35 U.S.C. 154(b) by 364 days.

(21) Appl. No.: 13/015,441

(22) Filed: Jan. 27, 2011

(65) Prior Publication Data

US 2012/0194592 A1 Aug. 2, 2012

(51) Int. Cl.
*B41J 2/205* (2006.01)
*B41J 29/38* (2006.01)

(52) U.S. Cl.
USPC ..... 347/15; 347/5

(58) Field of Classification Search
USPC ..... 347/15
See application file for complete search history.

(56) References Cited

U.S. PATENT DOCUMENTS

| | | | | |
|---|---|---|---|---|
| 6,019,461 | A * | 2/2000 | Yoshimura et al. | 347/86 |
| 7,382,490 | B2 | 6/2008 | Lammens et al. | |
| 7,431,436 | B1 * | 10/2008 | Mills et al. | 347/85 |
| 2004/0184658 | A1 | 9/2004 | Inoue | |
| 2006/0092463 | A1 | 5/2006 | Ahn | |
| 2007/0165258 | A1 | 7/2007 | Farrell et al. | |
| 2008/0074686 | A1 | 3/2008 | Naito et al. | |
| 2010/0123911 | A1 | 5/2010 | Guay | |

FOREIGN PATENT DOCUMENTS

JP 2009037404 2/2009

* cited by examiner

*Primary Examiner* — Uyen Chau N Le
*Assistant Examiner* — Kajli Prince
(74) *Attorney, Agent, or Firm* — Duft, Bornsen & Fettig, LLP

(57) ABSTRACT

Methods and systems herein provide for allowing color profiles for printers to be determined based on the types of print engines installed at the printer and the types of colorants installed at the printer. In one embodiment, a printing system including a printer is disclosed. The printer comprises a colorant system, a print engine system, and a print controller. The colorant system identifies a type of colorant installed at the printer for printing to a physical media. The print engine system identifies a type of print engine installed at the printer for printing to the media using the colorant. The print controller receives a request for the type of colorant installed at the printer and the type of print engine installed at the printer to allow for a determination of a color profile for the printer.

17 Claims, 4 Drawing Sheets

COLOR PROFILE DETERMINATION FOR PRINTING SYSTEMS

FIELD OF THE INVENTION

The invention relates to the field of printing systems, and in particular, to determining color profiles for printers.

BACKGROUND

In printing systems, a color space describes how colors are represented by data. For example, a printer may have a CMYK output color space based on the use of Cyan, Magenta, Yellow, and Key black inks/toner (colorants) used when printing to media (e.g., paper). Print data used to generate the printed output may be based on a different color space, such as a RGB (Red, Green, and Black) color space. Because the color space of the print data (A RGB input color space in this case) is different than the output color space of the printer (a CMYK output color space in this case), a process is used to convert the input color space to the output color space during the printing process. This is done to ensure that the printed output accurately reflects the colors represented in the original print data.

Color profiles (e.g., ICC profiles as per the International Color Consortium standards) are often used to represent the output color space of printers. While one may expect that a printer may only have one color profile to describe the output color space, the converse is more likely. In printing systems, especially production printing systems, a wide variety of print engines and colorants may be installed and replaced within the printer depending on the printing needs of a customer. For example, a CMYK print engine may be installed along with dye based colorant for printing in one customer configuration, and then replaced with a monochrome print engine and monochrome ink for printing in another customer configuration. For a specific combination of engine and/or the colorant, a set of color profiles corresponding to the engine/colorant combination (and any media options when printing using the combination) is determined for the printer to ensure that the printed output (using the media options) accurately reflects the colors represented in the original print data. Also, a printer may have multiple print engines and colorants, with each combination of print engine/colorant associated with a potentially different color profile. For example, a top side of a sheet of paper may be printed with a monochrome print engine using dye based colorant, while the bottom side of the sheet of paper may be printed with a CMYK print engine using a pigment based colorant. Thus, one printing system may have dozens of color profiles for the printer, with each of the color profiles based on some combination of print engines and colorants that may be installed in the printer.

Prior to printing, a print operator determines a color profile corresponding to a currently installed combination of print engine and colorant at the printer. In some cases, the print operator may be presented with dozens of possible choices when attempting to determine the color profile for the printer. When the print operator chooses the wrong color profile (or profiles when multiple print engines are present on the printer), then unexpected and undesirable printing results occur. It thus remains a problem to accurately determine the correct color profile for a printer to ensure that the printed output accurately reflects the colors represented in the original print data.

SUMMARY

Embodiments described herein allow for a determination of color profiles for a printer based on the types of print engines installed at the printer and the types of colorants installed at the printer. In printing systems, a number of different print engines and colorants may be used for printing. Each combination of print engine and colorant may correspond to a different color profile that is used when converting print data to match the output color space of the printer. When a print operator selects an incorrect color profile, an undesirable printed output occurs. In the embodiments described, a query is sent to the printer to identify the type of print engine installed at the printer and the type of colorant installed at the printer. Using the identified types, color profiles may be selected that correctly correspond to the current configuration of the printer. This reduces the opportunity for the print operator to select an incorrect color profile for the printer, which reduces printing errors In one embodiment, a printing system including a printer is disclosed. The printer comprises a colorant system, a print engine system, and a print controller. The colorant system is operable to identify a type of colorant installed at the printer for printing to a physical media. The print engine system is operable to identify a type of print engine installed at the printer for printing to the media using the colorant. The print controller is operable to receive a request for the type of colorant installed at the printer and the type of print engine installed at the printer to allow for a determination of a color profile for the printer. The print controller is further operable to query the colorant system and the print engine system to identify the type of colorant and the type of print engine, and to respond to the request to allow for the determination of the color profile for the printer based on the type of colorant and the type of print engine.

In another embodiment, a method is disclosed for allowing a color profile for a printer to be determined. The method may also be embodied as programmed instructions on a tangible computer readable medium for execution by a processing system. According to the method, a request is received for a type of colorant installed at a printer and a type of print engine installed at the printer to allow for a determination of a color profile for the printer. Identifications are made as the type of colorant installed at the printer for printing to a physical media, and to the type of print engine installed at the printer for printing to the media using the colorant. A response is made to the request to allow for the determination of the color profile for the printer based on the type of colorant and the type of print engine.

Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DESCRIPTION OF THE EMBODIMENTS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
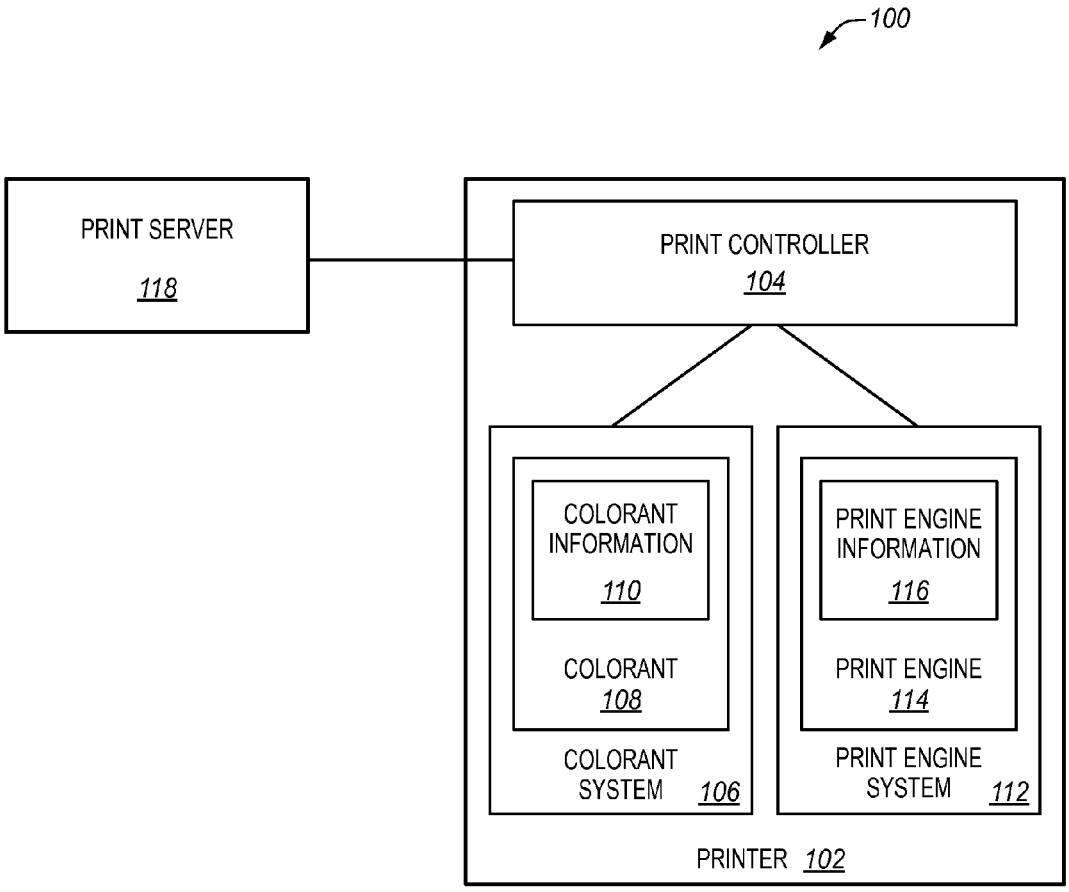
FIG. 1 is a block diagram of a printing system in an exemplary embodiment.

FIG. 1 is a block diagram of a printing system 100 in an exemplary embodiment. Printing system 100 includes a printer 102 and, in some embodiments, a print server 118 in communication with printer 102. Although only one printer 102 is shown in printing system 100, a plurality of printers may be present and in communication with print server 118. Printer 102 generally receives print data and transforms the print data to a physical media, such as paper. As discussed in the Background, prior to printing on printer 102, a print operator selects one or more color profiles corresponding to the currently installed print engines and colorants at printer 102. When the print operator inadvertently selects the wrong color profile for printer 102, then unexpected and undesirable printing results occur. Printer 102 solves this and other related problems by allowing for a determination of a color profile for printer 102 based on a type of colorant 108 installed at printer 102 and a type of print engine 114 installed at printer 102. A type of print engine generally means any kind of physical characteristic of the print engine that may affect how print data is transformed to a physical media. A type of colorant generally means any kind of physical characteristic of the colorant that may affect how print data is transformed to a physical media. For example, a type of colorant may be classified based on a chemical composition and density of the colorant. Pigment colorants, dye ink colorants, and toner colorants each may have different chemical properties, densities, and chemical compositions. These differences between colorants affect how the print data is represented on the media using the colorants.

In printer 102, a print controller 104 comprises any component, system, or device operable to communicate with one or more systems (e.g., print server 118), receive print data, and process the print data during the printing process. Print controller 104 is also operable to communicate with a colorant system 106 when identifying a type of colorant 108 installed at printer 102, and operable to communicate with a print engine system 112 when identifying a type of print engine 114 installed at printer 102.

Colorant system 106 comprises any component, system, or device operable to identify a type of colorant 108 installed at printer 102 (e.g., by retrieving colorant information 110 associated with colorant 108). Print engine system 112 comprises any component, system, or device operable to identify a type of print engine 114 installed at printer 102 (e.g., by retrieving print engine information 116 associated with print engine 114).

Print server 118 may query print controller 104 to identify colorant information 110 and print engine information 116, and then use the information to allow a print operator to select one or more color profiles for printer 102 that match the configuration on printer 102. How printing system 100 operates, and more particularly how printer 102 operates, will be discussed in more detail with regard to FIG. 2.

Figure 2:
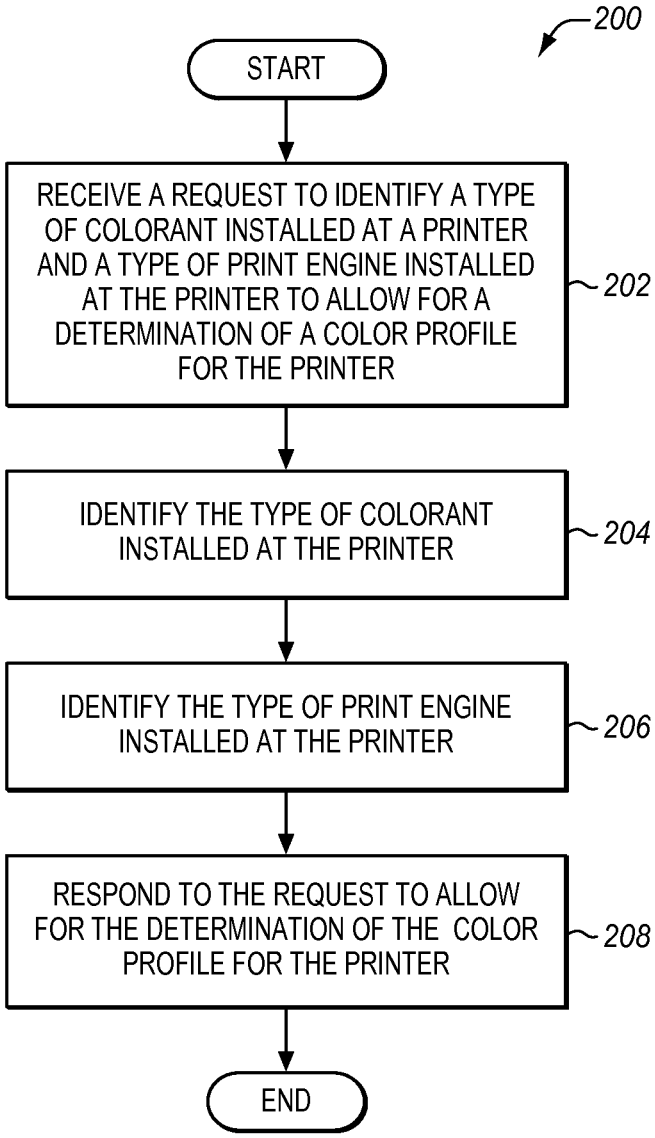
FIG. 2 is a flow chart illustrating a method allowing for a determination of a color profile for a printer in an exemplary embodiment.

FIG. 2 is a flow chart illustrating a method 200 allowing for a determination of a color profile for a printer in an exemplary embodiment. The steps of method 200 will be described with respect to printing system 100 of FIG. 1, although one skilled in the art will understand that method 200 may be performed by systems not shown. The steps of method 200 described herein are not all inclusive and may include other steps not shown. The steps may also be performed in an alternative order.

In step 202, print controller 104 receives a request to identify a type of colorant 108 installed at printer 102 and a type of print engine 114 installed at printer 102 to allow for a determination of an color profile for printer 102. Print controller 102 may receive the request from print server 118 or from another host system not shown. The request may be received in a number of message formats, including Transmission Control Protocol (TCP) messages, Server Message Block (SMB) messages, Simple Networking Management Protocol (SNMP), etc.

In step 204, printer 102 identifies a type of colorant 108 installed at printer 102. Although only one print colorant 108 is shown installed at printer 102, one skilled in the art understands that a plurality of colorants may be installed at printer 102. When identifying colorant 108, print controller 104 may query colorant system 106 to retrieve colorant information 110 associated with colorant 108. For example, colorant 108 may be dispensed in bags or other types of containers with attached electronic tags, such as Radio Frequency Identification Device (RFID) tags, electronic integrated circuit tags, etc. Thus, when print controller 102 generates a query for colorant system 106 to identify colorant 108, colorant system 106 may read the RFID tag attached to the container of colorant 108 to retrieve colorant information 110. Colorant information 110 may indicate that colorant 108 is a pigment colorant, a dye colorant, a Magnetic Ink Character Recognition (MICR) colorant, a monochrome colorant, or some other type of colorant.

In step 206, printer 102 identifies the type of print engine 114 installed at printer 102. Although only one print engine 114 is shown installed at printer 102, one skilled in the art understands that a plurality of print engines may be installed at printer 102. For example, duplex printing may entail a separate print engine for each side of a sheet of paper. This is particularly common in high volume printing using continuous form media. When identifying print engine 114, print controller 104 may query print engine system 112 to retrieve print engine information 116 associated with print engine 114. For example, print engine 114 may store print engine information 116 in a non-volatile memory of print engine 116, or print engine 114 may store print engine information 116 within firmware executing on print engine 114. Thus, when print controller 102 generates a query for print engine system 112 to identify print engine 114, print engine system 112 may read the non-volatile memory within print engine 114 to retrieve print engine information 116 or may issue commands to a processing system executing on print engine 114 to retrieve print engine information 116. Print engine information 116 may indicate that print engine 114 is a CMYK (Cyan, Magenta, Yellow, and Key black) print engine, a monochrome print engine, or some other type of print engine.

In step 208, print controller 104 responds to the request to allow for the determination of a color profile for printer 102 based on a type of colorant 108 (e.g., using colorant information 110) and a type of print engine 114 (e.g., using print engine information 116). For example, in some embodiments, print server 118 may receive the response from printer 102, and may process the response to identify colorant information 110 and print engine information 116. Using colorant information 110 and print engine information 116, print server 120 may determine that one or more color profiles associated with printer 102 are valid for printer 102. In printing systems, a wide variety of print engines and colorants may be used within the same printer. Each combination of print engine and colorant may entail a different color profile to accurately represent the output color space of the printer based on the combination. Also, specific media loaded in printer 102 may also modify a set of color profiles that are valid for a specific combination of print engines and colorants installed at printer 102. For instance, out of a possible set of 10 valid color profiles for a specific combination, the media used may eliminate some profiles from being valid.

If print server 118 determines that a color profile is a valid profile for printer 102, this may allow print server 118 to present the valid color profile to a printer operator and to ignore the non-valid color profiles. When a non-valid color profile is no longer available for selection by the print operator, the opportunity for the print operator to make an error when selecting color profiles for printer 102 is reduced, which reduces the printing errors for printing system 100.

EXAMPLE

Figure 3:
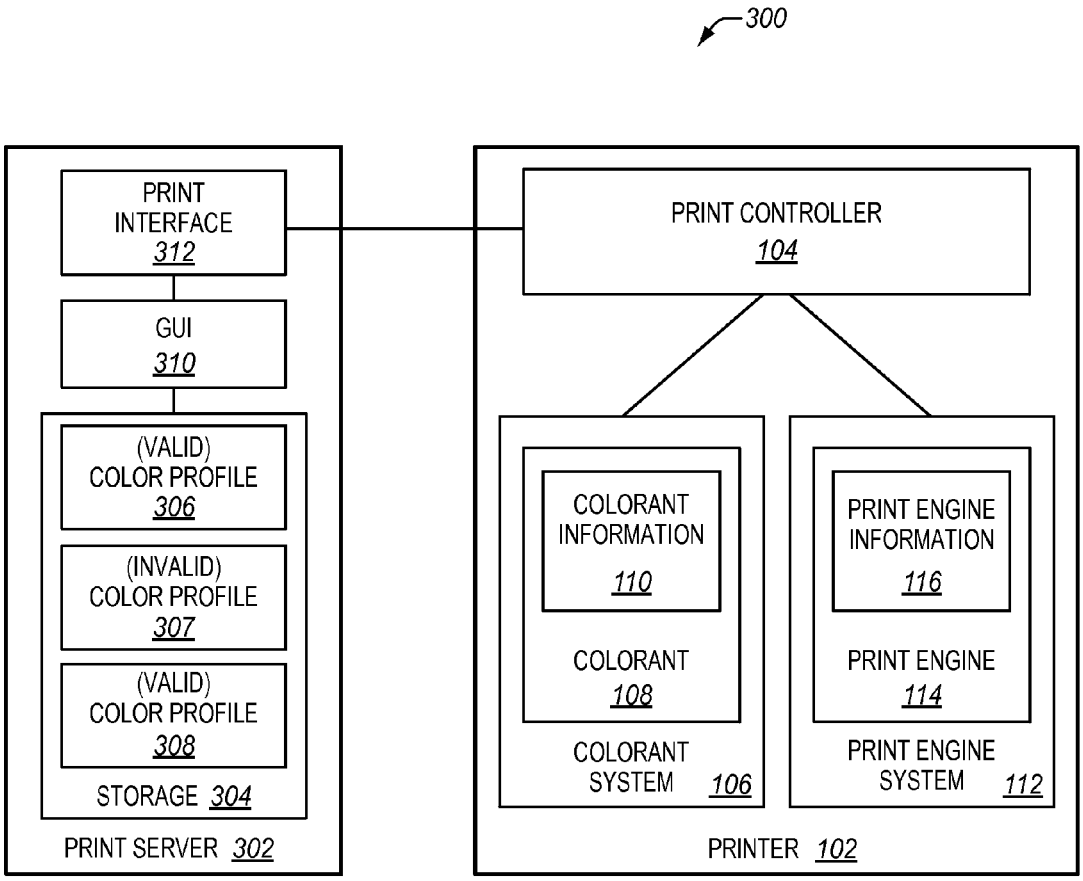
FIG. 3 is a block diagram of a printing system in another exemplary embodiment.

In the example, consider a printing system 300 of FIG. 3. FIG. 3 is a block diagram of printing system 300 in another exemplary embodiment. In like manner to printing system 100 of FIG. 1, printing system 300 of FIG. 3 includes printer 102. Printing system 300 also includes a print server 302. Print server 302 receives print jobs from clients (not shown in FIG. 3) and allows a print operator to select one or more color profiles 306-308 stored in storage 304 of print server 302. Color profiles 306-308 are used for converting the print jobs received from the clients to an output color space suitable for printer 102 based on the combination of print engine 114 and colorant 108 installed at printer 102. Print server 302 also includes a print interface 312 for communicating with printer 102. Print server 302 further includes a Graphical User Interface (GUI) 310. GUI 310 allows the print operator to control and interact with print server 302. In the example, print server 302 receives a print job from a client for printing. Information for the print job (e.g., within a job ticket) indicates that check stock using a MICR based colorant is to be used when printing the print job. MICR colorants are magnetic based, so they are machine readable by financial institutions. In setting up printer 102 for the print job, a print operator removes a CMYK print engine from printer 102 and installs a monochrome print engine 114 in its place. The print operator also removes pigment based colorant from printer 102 and installs a MICR colorant 108 in its place. Using GUI 310 of print server 302, the print operator begins to set up the print job for printing on printer 102. As part of the set up process, the print operator will select one or more color profiles 306-308 for printer 102. Print server 302 may then query printer 102 to identify colorant information 110 and print engine information 116. Using colorant information 110 and print engine information 116, print server 302 determines that color profiles 306 and 308 are valid for the combination of monochrome print engine 112 and MICR colorant 108 installed at printer. Print server 118 may then generate or link to a directory of color profiles 306 and 308. The print operator may then view a list of color profiles 306 and 408 using GUI 312 that are correct for converting the input color space of the print job to the output color space of printer 102. As invalid color profile 307 is not displayed to the print operator for selection, this reduces the opportunities for errors in selecting color profiles 306-308 for printer 102.

Figure 4:
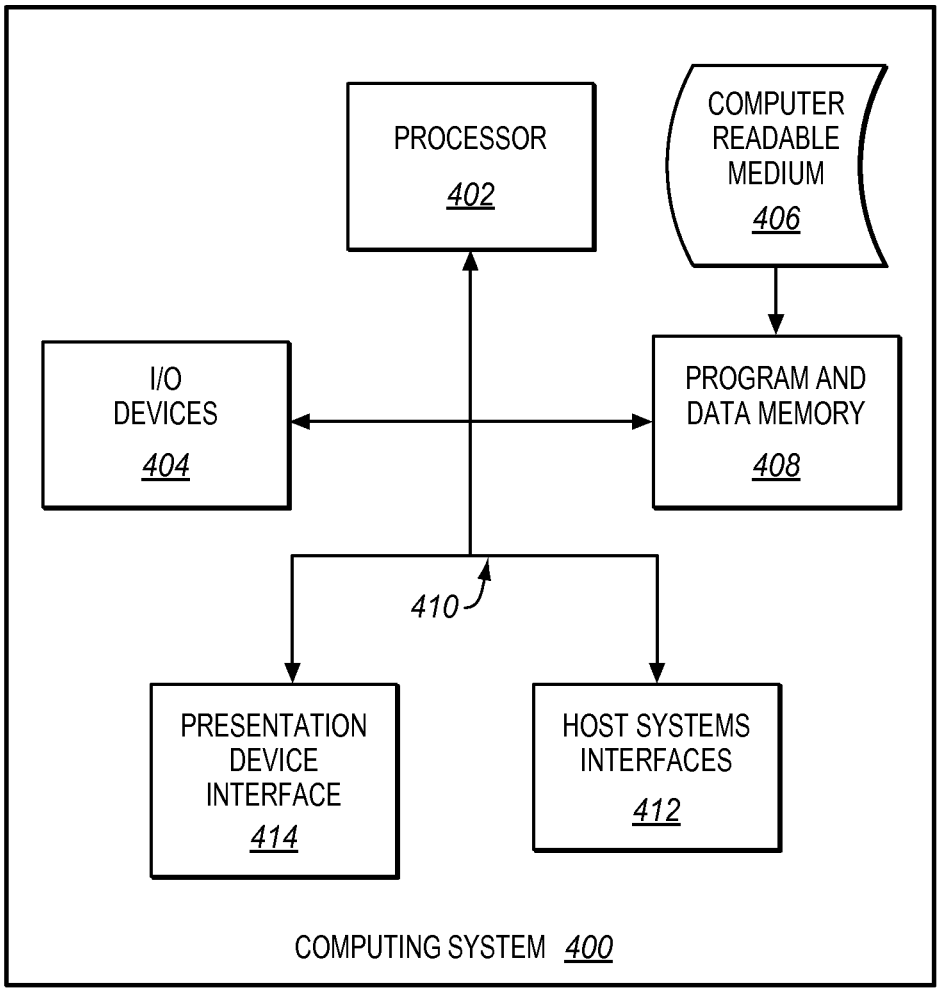
FIG. 4 illustrates a computing system in which a computer readable medium may provide instructions for performing the methods of FIG. 2 in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 4 illustrates a computing system 400 in which a computer readable medium 406 may provide instructions for performing method 200 in an exemplary embodiment.

Furthermore, the invention can take the form of a computer program product accessible from a computer-usable or computer-readable medium 406 providing program code for use by or in connection with a computer or any instruction execution system. For the purposes of this description, a computer-usable or computer readable medium 406 can be any apparatus that can contain, store, communicate, propagate, or transport the program for use by or in connection with the instruction execution system, apparatus, or device.

The medium 406 can be an electronic, magnetic, optical, electromagnetic, infrared, or semiconductor system (or apparatus or device) or a propagation medium. Examples of a computer-readable medium 406 include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disk—read/write (CD-R/W) and DVD.

A data processing system suitable for storing and/or executing program code will include one or more processors 402 coupled directly or indirectly to memory 408 through a system bus 410. The memory 408 can include local memory employed during actual execution of the program code, bulk storage, and cache memories which provide temporary storage of at least some program code in order to reduce the number of times code is retrieved from bulk storage during execution.

Input/output or I/O devices 404 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 412, or remote printers or storage devices through intervening private or public networks. Modems, cable modem and Ethernet cards are just a few of the currently available types of network adapters.

Although specific embodiments were described herein, the scope of the invention is not limited to those specific embodiments. The scope of the invention is defined by the following claims and any equivalents thereof.

We claim:

1. A printing system including:

a printer comprising:

a colorant system operable to identify a type of colorant installed at the printer for printing to a physical media;

a print engine system operable to identify a type of print engine installed at the printer for printing to the media using the colorant; and a print controller operable to receive a request to identify the type of colorant installed at the printer and the type of print engine installed at the printer to allow for a determination of a color profile for the printer, to query the colorant system and the print engine system to identify the type of colorant and the type of print engine, and to respond to the request to allow for the determination of the color profile for the printer based on the type of colorant and the type of print engine; and a print server operable to receive the response to the request, to process the response to identify the type of colorant and the type of print engine, and to determine that at least one of a plurality of color profiles is not valid for the printer based on the type of colorant installed at the printer and the type of print engine installed at the printer.

2. The printing system of claim 1 wherein the colorant system is further operable to query an electronic tag affixed to a reservoir of colorant to identify the type of colorant installed at the printer.

3. The printing system of claim 2 wherein the electronic tag is a Radio Frequency Identification Device (RFID) tag.

4. The printing system of claim 1 wherein the print engine system is further operable to query a control system operating within the print engine to identify the type of print engine.

5. The printing system of claim 1 wherein the colorant system is further operable to identify at least one of a pigment colorant, a dye colorant, a Magnetic Ink Character Recognition (MICR) colorant, and a monochrome colorant installed at the printer.

6. The printing system of claim 1 wherein the print engine system is further operable to identify at least one of a CMYK print engine installed at the printer and a monochrome print engine installed at the printer.

7. A method comprising:

receiving a request for a type of colorant installed at a printer and a type of print engine installed at the printer to allow for a determination of a color profile for the printer;

identifying the type of colorant installed at the printer for printing to a physical media;

identifying the type of print engine installed at the printer for printing to the media using the colorant;

responding to the request to allow for the determination of the color profile for the printer based on the type of colorant and the type of print engine;

receiving the response to the request;

processing the response to identify the type of colorant and the type of print engine; and determining that at least one of a plurality of color profiles is not valid for the printer based on the type of colorant installed at the printer and the type of print engine installed at the printer.

8. The method of claim 7 wherein identifying the type of colorant installed at the printer further comprises:

querying an electronic tag affixed to a reservoir of colorant to identify the type of colorant installed at the printer.

9. The method of claim 8 wherein the electronic tag is a Radio Frequency Identification Device (RFID) tag.

10. The method of claim 7 wherein identifying the type of print engine installed at the printer further comprises:

querying a control system operating within the print engine to identify the type of print engine.

11. The method of claim 7 wherein identifying the type of colorant further comprises:

identifying at least one of a pigment colorant, a dye colorant, a Magnetic Ink Character Recognition (MICR) colorant, and a monochrome colorant installed at the printer.

12. The method of claim 7 wherein identifying the type of print engine further comprises:

identifying at least one of a CMYK print engine installed at the printer and a monochrome print engine installed at the printer.

13. A non-transitory computer readable medium tangibly embodying programmed instructions which, when executed by a processing system, are operable to perform a method of allowing a color profile for a printer to be determined, the method comprising:

receiving a request for a type of colorant installed at a printer and a type of print engine installed at the printer to allow for a determination of a color profile for the printer;

identifying the type of colorant installed at the printer for printing to a physical media;

identifying the type of print engine installed at the printer for printing to the media using the colorant;

responding to the request to allow for the determination of the color profile for the printer based on the type of colorant and the type of print engine;

receiving the response to the request;

processing the response to identify the type of colorant and the type of print engine; and determining that at least one of a plurality of color profiles is not valid for the printer based on the type of colorant installed at the printer and the type of print engine installed at the printer.

14. The computer readable medium of claim 13 wherein the method step of identifying the type of colorant installed at the printer further comprises:

querying an electronic tag affixed to a reservoir of colorant to identify the type of colorant installed at the printer.

15. The computer readable medium of claim 14 wherein the electronic tag is a Radio Frequency Identification Device (RFID) tag.

16. The computer readable medium of claim 13 wherein the method step of identifying the type of print engine installed at the printer further comprises:

querying a control system operating within the print engine to identify the type of print engine.

17. The computer readable medium of claim 13 wherein the method step of identifying the type of colorant further comprises:

identifying at least one of a pigment colorant, a dye colorant, a Magnetic Ink Character Recognition (MICR) colorant, and a monochrome colorant installed at the printer.

* * * * *